US012371212B2

(12) United States Patent
Quintero

(10) Patent No.: US 12,371,212 B2
(45) Date of Patent: Jul. 29, 2025

(54) PACKAGING AND METHOD FOR PLANT MATTER

(71) Applicant: VIRGIN FRUIT, Inc., Miami, FL (US)

(72) Inventor: Wilson Quintero, Miami, FL (US)

(73) Assignee: VIRGIN FRUIT, Inc., Miami, FL (US)

( * ) Notice: Subject to any disclaimer, the term of this patent is extended or adjusted under 35 U.S.C. 154(b) by 0 days.

(21) Appl. No.: 17/914,098

(22) PCT Filed: Mar. 22, 2021

(86) PCT No.: PCT/US2021/023519
§ 371 (c)(1),
(2) Date: Sep. 23, 2022

(87) PCT Pub. No.: WO2021/194988
PCT Pub. Date: Sep. 30, 2021

(65) Prior Publication Data

US 2024/0109705 A1 Apr. 4, 2024

Related U.S. Application Data

(60) Provisional application No. 62/993,574, filed on Mar. 23, 2020.

(51) Int. Cl.

| | |
|---|---|
| ***B65B 1/00*** | (2006.01) |
| ***B65B 5/04*** | (2006.01) |
| ***B65B 7/16*** | (2006.01) |
| ***B65B 25/02*** | (2006.01) |
| ***B65B 25/04*** | (2006.01) |
| ***B65B 31/00*** | (2006.01) |
| ***B65B 53/00*** | (2006.01) |
| ***B65B 55/00*** | (2006.01) |
| ***B65D 21/02*** | (2006.01) |
| ***B65D 75/32*** | (2006.01) |
| ***B65D 77/20*** | (2006.01) |

(Continued)

(52) U.S. Cl.
CPC ..... *B65B 25/02* (2013.01); *B65B 1/00* (2013.01); *B65B 5/04* (2013.01); *B65B 7/162* (2013.01); *B65B 7/165* (2013.01); *B65B 25/041* (2013.01); *B65B 31/00* (2013.01); *B65B 53/00* (2013.01); *B65B 55/00* (2013.01); *B65D 21/0206* (2013.01); *B65D 75/327* (2013.01); *B65D 77/2024* (2013.01); *B65D 85/34* (2013.01); *B65D 85/505* (2013.01); *B65B 2230/02* (2013.01); *B65D 2575/3281* (2013.01); *B65D 2577/20* (2013.01)

(58) Field of Classification Search
CPC ..... B65D 85/34; B65D 75/367; B65D 77/02; B65D 81/266; B65B 25/001; B65B 47/08; B65B 61/007; B65B 51/02
USPC ..... 53/473
See application file for complete search history.

(56) References Cited

U.S. PATENT DOCUMENTS 4,966,296 A * 10/1990 Farrell ..... B65D 21/0206 206/820
6,086,931 A * 7/2000 Whiteford ..... B65D 85/324 426/106

(Continued)

*Primary Examiner* — Jacob A Smith
(74) *Attorney, Agent, or Firm* — Ted Whitlock; Santucci Priore PL

(57) ABSTRACT

Described is a packaging, and method and system for packaging an individual and single serving of plant matter, such as a cannabis flower. Also described are a method of making and using for the packaging.

9 Claims, 13 Drawing Sheets

Product Data Sheet

| Film Type | Gauge |
|---|---|
| F LBN 3.5 M | 3.50 |

Structure:
Nylon
LLDPE
Nylon
mLLDPE Sealant

Seal Type: Fusion

Typical Values:

| Property | Method | | Units | Value |
|---|---|---|---|---|
| Gauge | | | mils | 3.50 |
| Yield | | | sq inches/pound | 8,166 |
| Basis Weight | | | pounds/3000 sq ft | 52.9 |
| MVTR | ASTM 1249 | | g/100sq in/day @ 100F/90% rh | 0.50 |
| OTR 100% oxygen | ASTM D3985 | | cc/100sq in/day @ 73F/0% rh | 6.00 |
| Haze | ASTM D1003 | | Percent | 6 |
| Tensile, Ultimate | ASTM D882 | MD | psi | 4,500 |
| | | TD | psi | 4,000 |
| Elongation, Ultimate | ASTM D882 | MD | Percent | 426 |
| | | TD | Percent | 426 |
| 1% Secant Modulus | | MD | psi | 92,050 |
| | | TD | psi | 93,500 |
| | | | | |
| | | | | |

(51) Int. Cl.
*B65D 85/34* (2006.01)
*B65D 85/50* (2006.01)

(56) References Cited

U.S. PATENT DOCUMENTS

| | | | | |
|---|---|---|---|---|
| 6,213,302 | B1 * | 4/2001 | Sanders | B65D 85/34 206/521.1 |
| 2009/0039079 | A1 * | 2/2009 | Lipinski | B65D 21/0206 220/23.4 |
| 2011/0027438 | A1 * | 2/2011 | Finkowski | B65B 47/02 53/127 |
| 2017/0107048 | A1 * | 4/2017 | Adam | B65B 35/06 |
| 2019/0307640 | A1 * | 10/2019 | Vaughn | A61J 1/00 |

* cited by examiner

Product Data Sheet

| Film Type | Gauge |
|---|---|
| F LBN 3.5 M | 3.50 |

Structure:

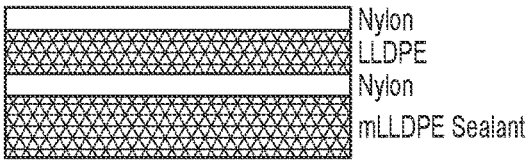

Seal Type: Fusion

Typical Values:

| Property | Method | | Units | Value |
|---|---|---|---|---|
| Gauge | | | mils | 3.50 |
| Yield | | | sq inches/pound | 8,166 |
| Basis Weight | | | pounds/3000 sq ft | 52.9 |
| MVTR | ASTM 1249 | | g/100sq in/day @ 100F/90% rh | 0.50 |
| OTR 100% oxygen | ASTM D3985 | | cc/100sq in/day @ 73F/0% rh | 6.00 |
| Haze | ASTM D1003 | | Percent | 6 |
| Tensile, Ultimate | ASTM D882 | MD | psi | 4,500 |
| | | TD | psi | 4,000 |
| Elongation, Ultimate | ASTM D882 | MD | Percent | 428 |
| | | TD | Percent | 426 |
| 1% Secant Modulus | | MD | psi | 92,050 |
| | | TD | psi | 93,500 |
| | | | | |
| | | | | |

FIG. 1

Product Data Sheet

| Film Type | Gauge |
|---|---|
| NFX NB BOP .70-2.0 M | 2.75 |

Structure:

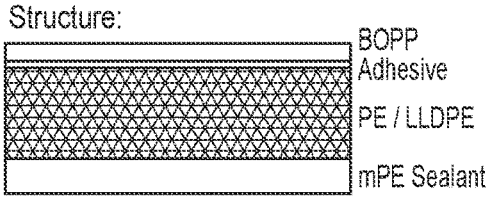

Seal Type: Fusion

Typical Values:

| Property | Method | | Units | Value |
|---|---|---|---|---|
| Gauge | | | mils | 2.75 |
| Yield | | | sq inches/pound | 19,890 |
| Basis Weight | | | pounds/3000 sq ft | 21.7 |
| MVTR | ASTM 1249 | | g/100sq in/day @ 100F/90% rh | 0.25 |
| OTR 100% oxygen | ASTM D3985 | | cc/100sq in/day @ 73F/0% rh | 90.00 |
| Haze | ASTM D1003 | | Percent | 8 |
| Tensile, Ultimate | ASTM D882 | MD | psi | 5,800 |
| | | TD | psi | 9,200 |
| Elongation, Ultimate | ASTM D882 | MD | Percent | 140 |
| | | TD | Percent | 60 |
| 1% Secant Modulus | | MD | psi | 120,000 |
| | | TD | psi | 92,000 |
| | | | | |
| | | | | |

FIG. 2

| TOP REEL | |
|---|---|
| FILM WIDTH | 415 (0/+2) |
| DIAM_MAX | 300 mm |
| Material | OPA/PE |
| THICKNESS | 70-150µm |
| CORE DIAMETER | 3° (76 mm) |
| SEALING FACE | INSIDE |
| PRINTABLE FACE | OUTSIDE |

| BOTTOM REEL | |
|---|---|
| FILM WIDTH | 420 (0/+2) |
| DIAM_MAX | 350 mm |
| Material | PA/PE |
| THICKNESS | 200µm |
| CORE DIAMETER | 3° (76 mm) |
| SEALING FACE | INSIDE |

All dimensions in Metric System

Graph 4 - Total Terpene Concentrations

PACKAGING AND METHOD FOR PLANT MATTER

BACKGROUND OF THE INVENTION

Plant matter harvested for human or animal consumption is susceptible to natural decay over time, and especially susceptible to degradation or deterioration when exposed to environmental factors such as air, oxygen, humidity, UV light, or increased temperatures that can exacerbate the degradation or deterioration of the harvested plant matter. Degradation or deterioration of fresh plant matter includes changes to its appearance, as well as changes to its content, e.g., loss of nutritional value or production of compounds that can affect its color, aroma, flavor, or use. The changes can result in rejection of the product by the consumer, and lead to overall waste, and economic loss to the seller. Degradation or deterioration of fresh plant matter has been a perennial problem in the food industry, e.g., fresh produce markets.

The appearance, flavor, texture, and crispness, and overall quality of fresh fruit rapidly deteriorates particularly when the flesh of the fruit is exposed, such as by peeling the skin or by slicing the fruit. Even citrus fruit, with a relatively higher content of citric acid—a natural preservative—can lose freshness within a short period of time when sliced and exposed to the air at room temperature or even below room temperature, e.g., refrigerated or stored on ice.

Cannabis plants contain a variety of cannabinoids whose commercial uses vary, but can include therapeutic or medicinal uses. Cannabis plants are generally classified according to the content of the cannabinoid, tetrahydrocannabinol (THC) Hemp is a cannabis plant whose THC content is 0.3% or less, while marijuana has a THC content above 0.3%. Cannabinoids, including THC, can undergo oxidative degradation upon exposure to air, heat, or light.

The cannabinoid content of a cannabis plant can be concentrated in the flower of the plant. Cannabis flowers are therefore a common cannabis plant product from which various forms of cannabinoids may be consumed or extracted. Cannabis flowers can be sold in many forms including the whole flower or can be processed, e.g., chopped or ground, for ease of handling, packaging, or transport. However, the appearance, texture, aroma, cannabinoid and terpene concentrations, and overall quality of a freshly harvested cannabis flower, is particularly prone to rapid deterioration following harvest of the plant, as the cannabinoid biosynthetic pathways are disrupted.

Storage of cannabis flowers in open containers or sealed containers that permit oxidative deterioration and the risk of fungal contamination is insufficient to prevent the degradation or deterioration of fresh cannabis plant.

Methods for preserving fresh plant matter are known but each method can be disadvantageous. For example, preservation methods that involve refrigeration or freezing can help preserve plant matter and maintain chemical stability for longer periods of time. However, these methods often fail to prevent oxidative degradation and can negatively impact the plant matter. Freezing of plant matter also requires freezing equipment and continual maintenance of low temperatures. Drying of the plant matter before packaging can preserve certain qualities or characteristics, of the plant matter, e.g., flavor, but texture, freshness and appearance can be substantially negatively affected.

Drying and curing cannabis flowers allow for a finite window in which the flower maintains optimal freshness but after which optimal freshness can only be maintained by controlling various elements carefully such as relative humidity, temperature, ambient oxygen levels, and UV exposure. Refrigeration can help to preserve cannabis flowers for a limited number of hours but cannot stop oxidative degradation. Additionally, preservation methods that involve cooking the fruit or citrus can negatively affect the flavor, texture and appearance of fruit. Chemical preservatives are often used alone or in conjunction with these methods of preserving, however they can leave a residual or undesirable taste.

In the food industry, preparation of sliced fruits prior to use and need is a common practice for saving time to provide customers or food and beverage preparation staff with readily available and accessible sliced fruit or citrus wedges when desired. However, prior preparation of sliced fruit or citrus wedges too far in advance can result in lower quality of the fruit or citrus over the course of the hours of operation. Bulk storage of large amounts of pre-sliced fruit or citrus wedges, such as in open bins or containers, also presents a risk of contamination. Preparation of pre-sliced fruit or citrus wedges in amounts more than needed for any particular time period can also lead to waste and loss of expended resources because the fruit or citrus can become unfit for presentation or consumption What is needed in the art is a packaging method and system for packaging and storing fresh plant matter that can preserve quality and freshness while providing convenient access to an individual unit of the fresh plant matter for use and consumption by a user or consumer. For example, it can be advantageous to provide fresh plant matter in an individual unit, such as single-use unit, packaged and stored in a way that reduces or eliminates the disadvantages of previously known storage and preservation practices. More specifically, a method or system for packaging and storing fresh plant matter, e.g., harvested cannabis flowers or prepared fruit or vegetable servings, such as wedges of citrus fruit, which can advantageously retain the appearance, texture, aroma, concentrations of nutrients or other desired compounds, and overall quality of the harvested or prepared plant matter, without the negative effects and disadvantages of the known processes, advances the art.

SUMMARY OF THE INVENTION

The present invention pertains to a method and system for packaging and storing fresh plant matter, which can advantageously preserve the plant matter by reducing the rate of its degradation or deterioration, e.g., its quality or appearance following harvesting, processing, and packaging, thereby extending the shelf life of the fresh plant matter product. The subject invention also includes a packaged product containing fresh plant matter. The method of the subject invention is described herein as relating to a cannabis flower and pre-sliced or prepared wedge of citrus fruit, such as a lemon, lime, or orange. However, it would be readily understood in the art that the invention can be applied to other plant matter such as spices, or herbs, or other plant matter that readily degrades or deteriorates upon exposure to environmental factors, and would benefit from the packaging method or system as described. What is meant by "plant matter" is any portion or part of a harvested plant or crop which is useful to be made available to a consumer.

The method and system of the subject invention can advantageously reduce or eliminate degradation or deterioration of the plant matter, thereby increasing the stability of the packaged plant matter and extend the shelf-life of the packaged plant matter product. The method and system of the invention can also advantageously lower risk of contamination of fresh plant matter. The benefits of the method and system of the subject invention include minimizing waste and contamination throughout the supply chain applicable to the production, transport and consumption of fresh plant matter. Current observations relating to the use of the packaging method of the subject invention have shown stability for packaged citrus wedges for more than three weeks, and product stability of up to 12 months for cannabis flowers under normal storage conditions.

In addition, the packaging and method according to the subject invention can substantially minimize or even eliminate certain risks of contamination by organisms causing food-borne illness, especially as it pertains to table-served citrus wedges and cannabis flowers.

More specifically, the subject invention concerns a packaging comprising a bottom component, which serves as a container for fresh plant matter, and a top component, which serves as a covering over the bottom component containing the fresh plant matter. The bottom component is preferably a molded compartment, having one or more recessed areas or "pockets" formed therein, each pocket capable of receiving an individual unit of the fresh plant matter. In an embodiment comprising two or more pockets, the bottom component can be formed such that the pockets can be separable from one another, whereby each individual unit of plant matter can be separated from the other individual unit or units to provide a single-use package. For example, the bottom component can include perforations formed therein in a pattern which facilitates separation of one individual unit from another.

The top component is preferably a film layer capable of sealably affixing to the bottom component. The top component can permanently affixed to the bottom component, or can be removably affixed to the bottom component. The top component can further be capable of being separated into individual units. For example, the top component can include perforations formed therein in a pattern which facilitates separation of one individual unit from another. More preferably, when perforations are formed in the bottom and top components of the packaging, the patterns of perforations in the top and bottom components are aligned or matched.

In a preferred embodiment, the molded compartment or pocket is formed having dimensions substantially conforming to the dimensions of an individual unit of the plant matter placed therein, being generally slightly larger to accommodate and hold the entirety of the individual unit of plant matter. For example, the molded compartment can be formed in a size, shape and depth conforming to the shape and dimensions of a unit of fresh cannabis flower. Alternatively, the molded compartment can be formed in a size, shape and depth conforming to the shape and dimensions of a single slice of fruit, such as a citrus wedge.

In a preferred embodiment, the bottom component is formed from a plastic sheet material, approximately 3.0 to 5.0 mils in thickness so that it can be molded into and retain a desired shape by a heating process, known in the art as "thermo-formed." The molded compartment is formed using a mold designed for forming the desired shape and size of the pocket.

The bottom component when thermo-formed, comprises a planar flange on its peripheral edge onto which the top component film layer can be sealingly disposed and affixed following filling of the compartment with a unit of fresh plant matter.

In a preferred embodiment, the film layer of the top component is about 2 to 3 mils in thickness and is preferably semi-permeable, meaning that the top component film layer is impermeable to harmful organisms and moisture, but may be permeable to gases so that natural emanations of gases from the plant matter do not build up inside the sealed pocket. In addition, the top non-forming film layer can be releasably affixed to the planar flange of the bottom component such that the top layer may be removed for accessing and serving the individual unit of fresh plant matter.

In a preferred embodiment, the bottom component is formed to comprise a plurality of recessed areas or pockets, each for receiving a single unit of plant matter. The bottom component can be perforated, or relief cut for separating the plurality of molded compartment into individual rows of trays, or individual trays, each having a releasably sealed or resealable top layer disposed onto the corresponding bottom component. Alternatively, the top component can be permanently sealed to the bottom component, whereby access to the unit of fresh plant matter contained within the compartment is gained by cutting or tearing of the top component material. Pre-formed perforations, relief cuts, or weakened areas can be provided in the top component to facilitate easy access to the contents and can be formed in a pattern which aligns with or matches the pattern of perforations or relief cuts formed in the bottom component.

The method of packaging fresh plant matter according to the subject invention includes the following steps:

a) providing the bottom component having at least one molded compartment formed therein for receiving and containing a unit of fresh plant matter;
b) providing the unit of fresh plant matter processed to fit within the molded compartment formed in the bottom component of the package;
c) placing the unit of fresh plant matter into said molded compartment of the bottom component; and
d) sealing the package using a film layer sealably affixed to the bottom component and forming the top component of the package unit. Preferably, the plant matter is vacuum sealed.

Optionally, the method of the subject invention can include the step of:

e) washing and air-drying the fresh plant matter prior to placing the unit of fresh plant matter into said molded compartment.

The method of the subject invention can further optionally comprise the step of:

f) Spraying or fogging the fresh plant matter with a preservative prior to sealing.

The method and system of the subject invention is particularly suited to freshly harvested cannabis flowers, or pre-sliced fruits, such as citrus wedges packaged for individual use. Advantageously, the method or system of the subject invention can provide increased stability of the packaged plant material and increased shelf-life for the packaged product.

The subject invention further includes a system for packaging and preserving fresh plant matter in a single-use consumer package unit, whereby a packaging/sealing apparatus comprising a reel/roller system is provided at the harvesting site or location of the grower harvested fresh plant matter is sorted and processed for packaging, and the method for packaging the fresh plant matter is carried out at harvesting site or grower location. The packaged fresh plant matter can then be transported to a point of sale. Advantageously, the fresh plant matter packaged at the harvesting site or grower location avoids bulk transport of the harvested plant matter to a remote packaging site, which can allow exposure to detrimental environmental factors that can cause degradation or deterioration of the plant matter. The system, which avoids, or which excludes the step of transporting the harvested plant matter to a remote packaging site, prevents or reduces the level of degradation or deterioration of the plant matter that can start almost immediately following harvest.

An embodiment of the subject invention includes the packaged fresh plant matter prepared by the method or system described herein.

BRIEF DESCRIPTION OF THE DRAWINGS

FIG. 1 is a Product Data Sheet for a material used to manufacture the bottom forming film layer of the packaging.

FIG. 2 is Product Data Sheet for a material used to manufacture the top non-forming film layer of the packaging.

DETAILED DESCRIPTION OF THE INVENTION

Figure 3A:
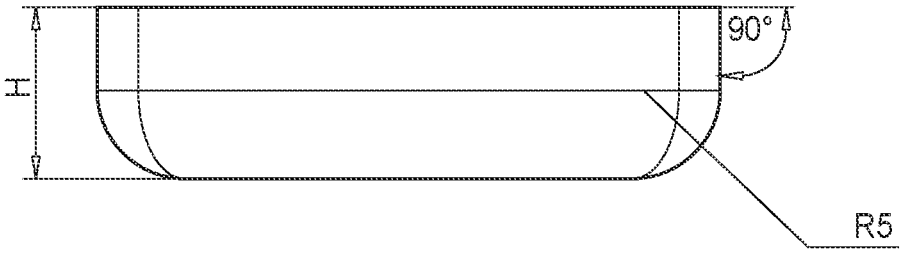
FIG. 3A is a plan view of a pocket formed in a bottom component or layer of the packaging.

This invention relates to a packaging for storing, preserving, or serving individual units of fresh plant matter so that plant matter can be stored without appreciable degradation or deterioration of the plant matter, which can result in loss of natural flavor, appearance, texture, color, aroma, nutrients or other compounds preferably retained in the plant matter. The invention also relates to a method of and system for packaging fresh plant matter in individual units or a plurality of individual units. The packaged fresh plant matter single-use unit or plurality of units, and method of using the individual units of packaged fresh plant matter also form part of the subject invention.

The term "fresh plant matter" as used in this application refers to plant matter immediately following harvest, or plant matter that has been harvested within a time period before packaging wherein the plant matter has not undergone substantial degradation or deterioration such that the degradation or deterioration negatively affects the desired quality or characteristics of the plant matter. The degree of freshness of the plant matter can depend on the type of plant, the conditions of harvest or storage conditions immediately following harvest, and other environmental factors that affect degradation or deterioration of the plant matter to be packaged. Preferably fresh plant matter is harvested plant matter that is packaged within a week of harvest, more preferably within about 72 hours of harvest; even more preferably within about 48 hours of harvest, still more preferably within about 24 hours of harvest, and most preferably from immediately following harvest to within about eight hours of harvest. The packaging and methods described herein are described using as an example the packaging of cannabis, more specifically, a cannabis flower, or a citrus fruit wedge, such as a lemon wedge. However, it would be understood that the method, system or packaging described herein can be applied to other plant matter susceptible to rapid loss of freshness or at risk of contamination due to handling, such as spices or herbs or other fresh fruits or vegetables, without detracting from the scope or concept of the invention.

The subject invention concerns a packaging comprising a first bottom component or layer, or "forming film" having formed or molded therein a recessed area or pocket for receiving a single unit of fresh plant matter. In a preferred embodiment, the recessed pocket is formed in a shape substantially and depth conforming to the shape and dimensions of the fresh plant matter. In a preferred embodiment, the forming film layer is a plastic sheet material, approximately 3.0 to 5.0 mils in thickness so that it can be molded into and retain a desired shape by a heating process, known in the art as "thermo-formed." The shaped pocket is formed using a mold designed for forming the desired shape and size of the pocket. This bottom component of the packaging can be conveniently referred to as the "tray" portion of the packaging.

It would be understood that the bottom component or tray formed thereby can be a flexible film material, a semi-rigid plastic layer, or a rigid plastic layer, so long as a pocket can be readily formed in the material, e.g., by a mold process. The thickness and rigidity of the bottom component or tray is limited only by what is practicable for use with fresh plant matter; and dimensions and rigidity limited by weight considerations for shipping and storage.

One embodiment of the subject invention includes a bottom component comprising a laminated material such as rollstock forming film having specifications as described and shown in FIG. 1.

F LBN 3.5 M is a coextruded flexible forming film for protective packaging of products which need medium barrier to oxygen. F LBN 3.5 M is a high performance multilayer film designed for vacuum pack applications and is ideal for gassy cheese products. The film clarity allows for visibility of package contents. The Metallocene LLDPE sealant provides a low seal initiation temperature with a broad process window. The nylon skin and core layers provide strength and durability with intermediate oxygen barrier. Packaging equipment include Thermoformable HFFS equipment (Multivac, Triomat, Rapidpak, Hopper, Mahaffey & Harder, etc).

The bottom component, when formed, can be formed to retain a planar flange on its peripheral edge onto which is sealingly disposed and affixed a top component, or non-forming film layer, following filling of the pocket with a unit of the fresh plant matter. In a preferred embodiment, the top component is about 2 to 3 mils in thickness and is semi-permeable, meaning that the top non-forming film layer is impermeable to harmful organisms and moisture, but may be permeable to gases so that natural emanations from the unit of fresh plant matter do not build up inside the sealed pocket. In addition, the top non-forming film layer can be releasably affixed to the planar flange of the bottom forming film layer, or tray, such that the top component may be removed for accessing and serving an individual unit of fresh harvested plant matter. Specifications for a laminate film useful for the top component of the packaging are exemplified in FIG. 2.

The laminate film is a clear-seal non-forming film which is a flexible web designed for frozen products. The film provides optimal oxygen permeability for vacuum packaged steaks which are quickly frozen to maintain "bloomed" color throughout distribution. The clarity of this film allows for visibility of package contents. Clear Metallocene Plastomer sealant is suitable for use with a wide variety of forming films. It is designed to provide strength and durability with ideal Oxygen permeation. Packaging Equipment include Thermoformable HFFS equipment (Multivac, Tiromat, Rpidpak, Hooper, Mahaffey & Harder, etc).

Figure 3B:
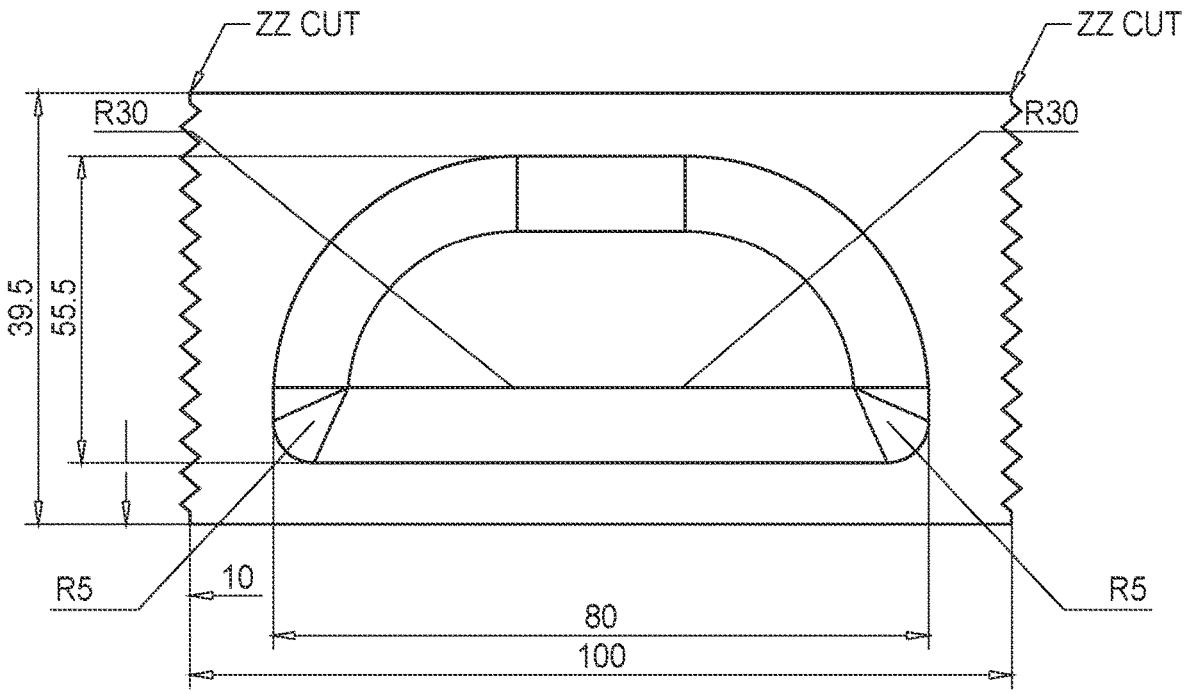
FIG. 3B is a top view of a pocket formed in a bottom component or layer of the packaging.
Figure 3C:
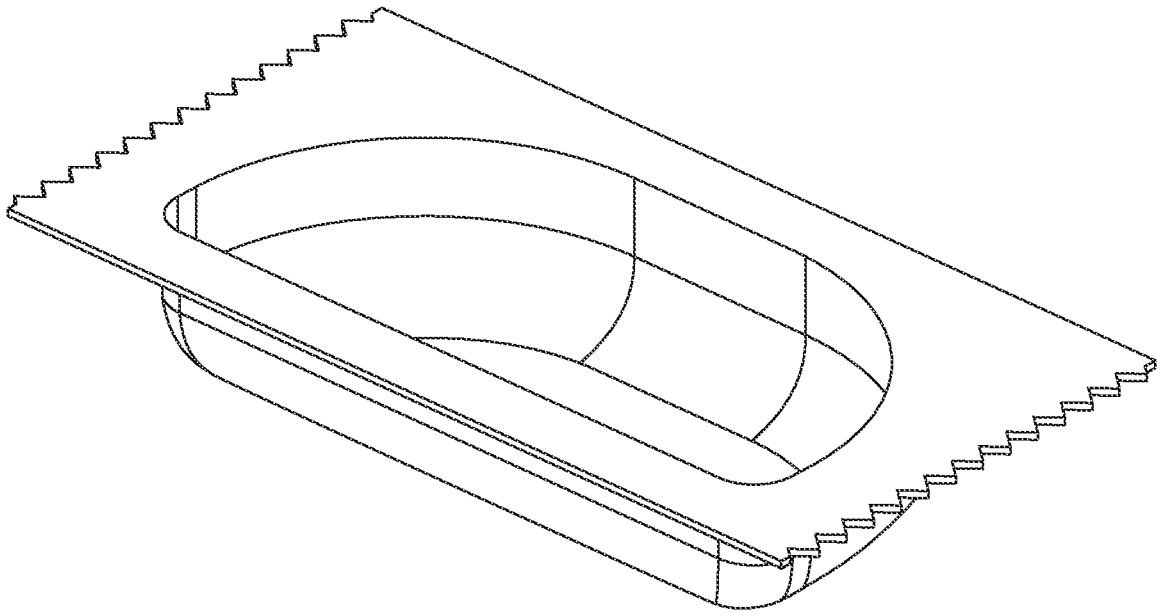
FIG. 3C is a perspective view of a pocket formed in the bottom component or layer of the packaging.

The pocket formed in the bottom component of the packaging is illustrated in FIG. 3A, FIG. 3B and FIG. 3C. FIG. 3A illustrates the atypical depth of the pocket formed in the bottom component to hold a single wedge of lime. FIG. 3B shows a top view illustrating the shape and dimension of the pocket opening, and FIG. 3C illustrates the pocket in perspective view.

Figure 4A:
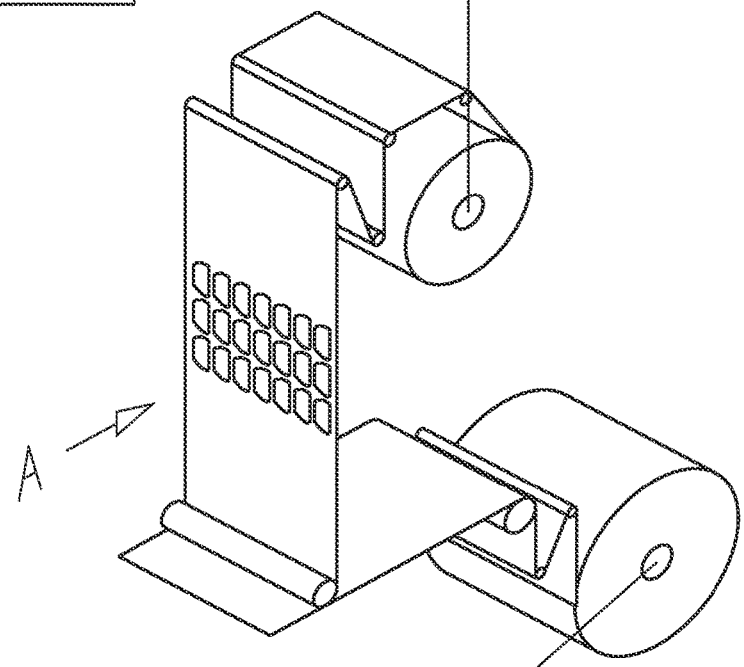
FIG. 4A illustrates a roller mechanism for forming a plurality of pockets in a sheet of bottom component material.
Figure 4B:
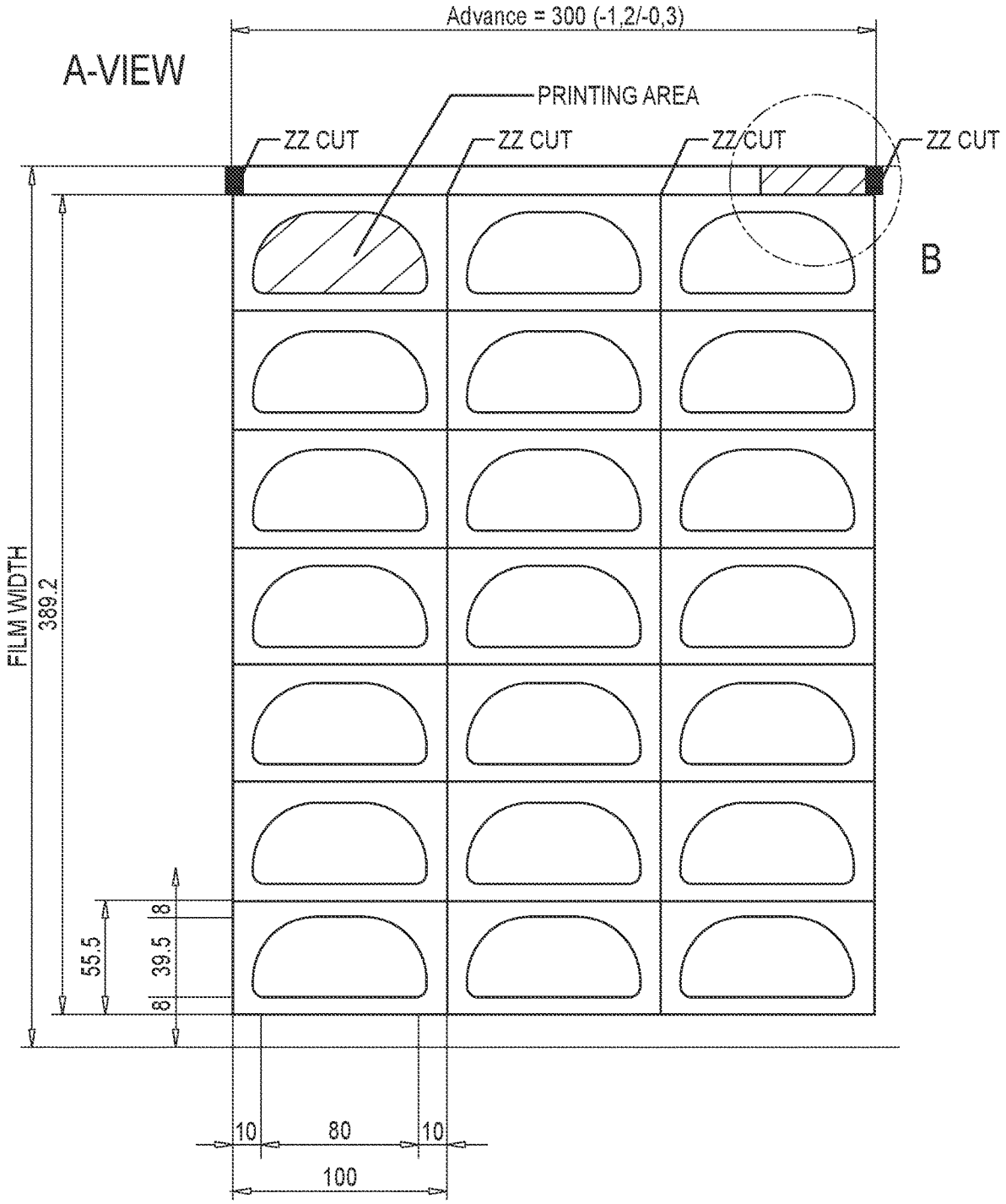
FIG. 4B illustrates a molded pattern of a plurality of pockets formed in a section of bottom component material.
Figure 4C:
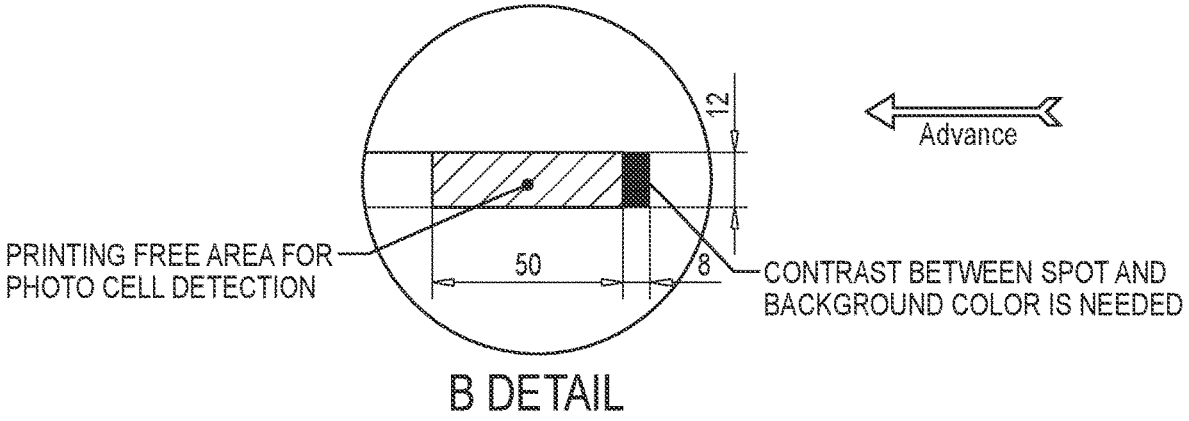
FIG. 4C is an enlarged view of the inset B in FIG. 4B.
Figure 5:
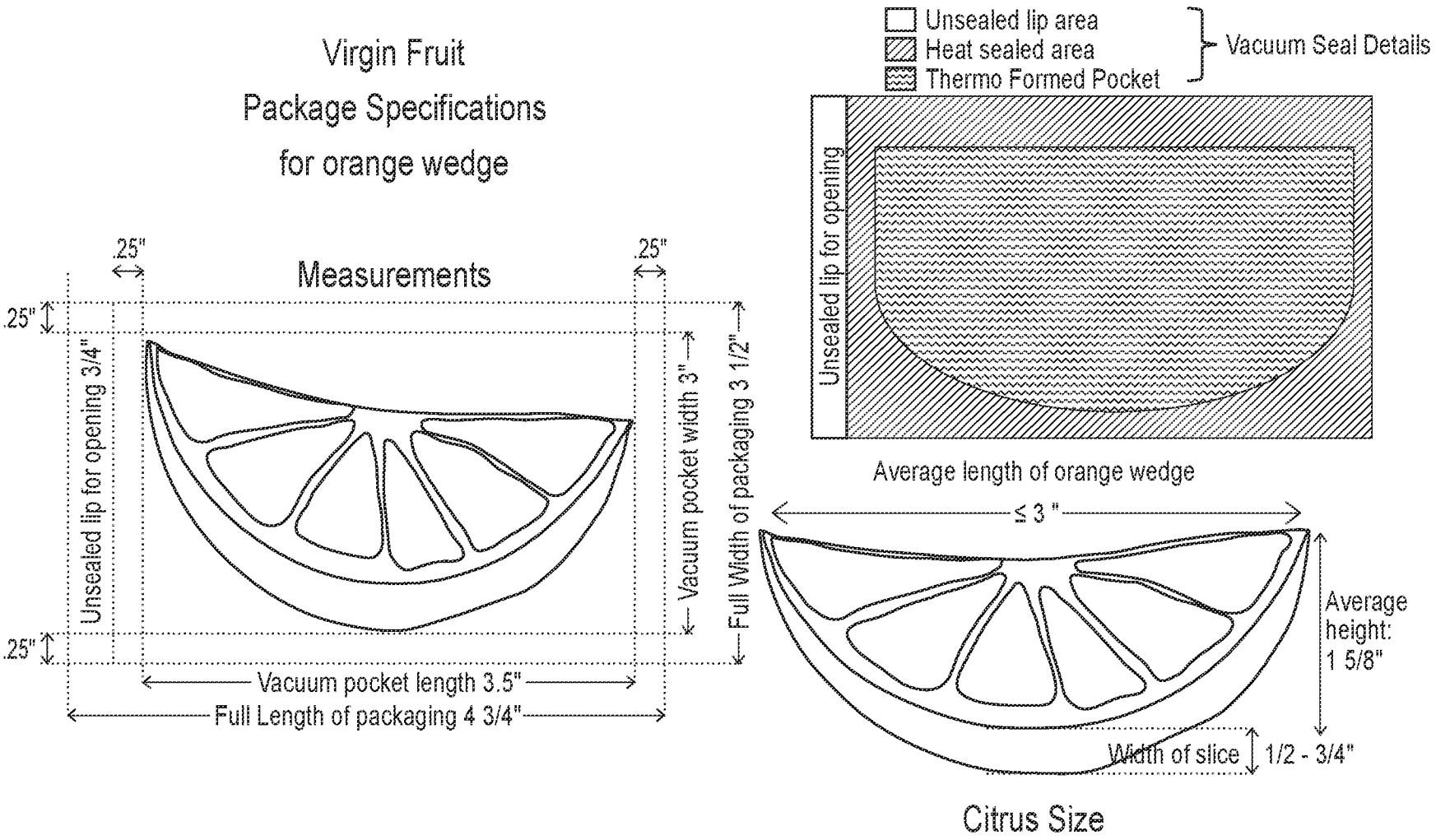
FIG. 5 shows packaging specifications for a citrus fruit wedge, and illustrates an unsealed lip on one edge of the pocket for removing the top non-forming film layer from the bottom component for accessing a citrus wedge contained therebetween.

In a more preferred embodiment, and as illustrated in FIGS. 4A and 4B, the bottom forming film component is manufactured to comprise a plurality of recessed areas or pockets, each for receiving a single slice of citrus wedge. The plurality of pockets can be formed in a single sheet of material, as illustrated in FIG. 4A. The bottom forming film component can be perforated or relief cut for separating the plurality of pockets into individual rows of trays (see "ZZ CUT" in FIG. 4B), or individual trays, each having a releasably sealed or resealable top component disposed onto the corresponding bottom component. Alternatively, the top component can be permanently sealed to the bottom component, whereby access to the individual unit of fresh plant matter contained within the pocket is gained by cutting or tearing of the top component material. Pre-formed perforations or weakened areas can be provided in the top component to facilitate easy access to the contents. FIG. 4C shows a close-up of inset B in FIG. 4B, illustrating a printing free area for photocell detection.

The method of packaging fresh plant matter according to the subject invention includes the following steps:

1. Freshly harvested plant matter is sorted into individual units capable of conforming to the size of the molded compartment formed within the bottom component of the packaging.
2. The sorted fresh plant matter can optionally be washed and dried, or further processed. For example, individual units of fresh plant matter can be cut or sliced, weighed or subjected to other pre-packaging techniques and apparatus known in the art. The individual units of fresh plant matter are then disposed into the thermoformed, molded compartment of the bottom component of the packaging. Preferably, the molded compartment is consistent with the size and shape of the individual unit of fresh plant matter so that the whole individual unit of fresh plant matter fits within the molded compartment and the molded compartment is deep enough to prevent the unit of fresh plant matter from extending upwardly past the peripheral edge or flange of the bottom component. This can provide the advantage of a substantially flat or planar upper surface of the packaging, even when filled, that can allow for convenient stacking, storage, and shipping of a plurality of packaged plant matter units.
3. Prior to sealing the packaged unit of fresh plant matter with the cover material, the fresh plant matter can optionally be sprayed or fogged with a preserving agent. Preferably, the preserving agent comprises all natural ingredients and is compatible with the packaging material and its contents. For packaging of fruit wedges, for example, the preserving agent can be a blend of citrus juice capable of being applied via a fogging system.

In use, for example, a licensed cannabis dispensary can obtain a plurality of cannabis flowers packaged individual single serving pouches or pockets in accordance with the subject invention.

When a customer requests a certain amount of cannabis flowers, sealed packages containing single cannabis flowers may be provided for use by the customer. The customer may therefore use a single cannabis flower without exposing the rest to contamination or deterioration.

The licensed dispensary is also not required to choose an individual cannabis flower from a container filled with individual cannabis flowers which may have been exposed to contamination and deterioration caused by exposure to air, humidity, heat, and light.

Similarly, a restaurant can obtain a plurality of citrus wedges packaged individual single serving pouches or pockets in accordance with the subject invention. When a restaurant customer requests a lemon wedge for her iced tea, a sealed package containing a single lemon wedge is provided and is opened for use by the customer. The restaurant server is not required to slice a lemon to obtain the wedge, nor is the server required to obtain a single wedge from a bin filled with pre-sliced wedges which may not be fresh and may have been exposed to contamination from others.

EXAMPLES

Example 1—Evaluation of Shelf-Life of Cannabis Flower in Specialized Packaging The shelf-life for cannabis flower was evaluated against various storage parameters, with ambient air (Ziploc® bag), with specialized packaging under vacuum, with and without UV exposure, and room temperature or elevated temperature conditions. In addition, storage under refrigeration (4° C.) and freezer conditions (−20° C.) were also considered. For the study, three key quality factors were used to assess the product stored under these conditions: cannabinoid concentration (CN), terpene concentrations (TP), and water activity or moisture analysis (WA). The sample and testing matrix are shown below in Table 1.

Results from this testing are compared to data collected for an initial sample, collected at time zero, to monitor changes over time.

TABLE 1

Sample and Testing Matrix

| Packaging | Temperature | UV Exposure | 1 month | 2 months | 3 months |
|---|---|---|---|---|---|
| Ziploc ® Bag | ambient | light | CN, TP, WA | CN, TP, WA | CN, TP, WA |
| Vacuum Packaging | ambient | light | CN, TP, WA | CN, TP, WA | CN, TP, WA |
| Vacuum Packaging | 40° C. | dark | CN, TP, WA | CN, TP, WA | CN, TP, WA |
| Ziploc ® Bag | 4° C. | dark | — | — | CN, TP, WA |
| Vacuum Packaging | 4° C. | dark | — | — | CN, TP, WA |
| Ziploc ® Bag | −20° C. | dark | — | — | CN, TP, WA |
| Vacuum Packaging | −20° C. | dark | — | — | CN, TP, WA |

CN = cannabinoid analysis,
TP = Terpene Analysis,
WA = Water activity (moisture analysis)

Packaging Methods

Prior to all packaging, sufficient cannabis flower to complete all testing was sourced and homogenized, to ensure product consistency between the various packaging and storage conditions. Homogenized cannabis flower was separated into aliquots of approximately 2 grams, enough to complete testing at each time point. Nine flower samples were placed into individual Ziploc® bags for the study. The remainder of the samples were packaged under vacuum in special packaging material.

For the vacuum packaging, forming temperatures of 85° C. (upper preheat) and 90° C. (lower preheat) were used. Packaging was heated for 1.0 second, then formed for 1.5 seconds, with a seal time of 2.0 seconds using a total flat seal plate which was set to 140° C. The vacuum pressure was set to 200 mlb, with ball valves used to restrict or soften the vacuum to an actual level of approximately 75-80 mlb, with an upper vent delay of 0.05 seconds.

Once all packaging was complete, samples were stored under the prescribed conditions. An additional aliquoted sample was submitted for immediate testing to establish the initial baseline values for cannabinoids, terpenes and moisture content, which will be used for comparison.

Analysis Methods

Cannabinoid analysis was performed using Ultra-Performance Liquid Chromatography (UPLC), with a photodiode array detector. Cannabinoid signals were verified by retention time in addition to UV spectral matching against a spectral library for reference compounds. Quantitation was performed against a calibration curve prepared from certified cannabinoid reference materials.

Terpene analysis was performed by Gas Chromatography with Mass Spectrometric detection (GCMS). Samples were introduced into the chromatographic system using a Head-Space auto-sampler, for which the samples were incubated at elevated temperature to evolve volatile terpene constituents prior to injection into the GCMS. Terpene signals were verified by retention time in addition to mass spectral matching against a NIST spectral library for reference compounds. Quantitation was performed against a calibration curve prepared from certified terpene reference materials.

Moisture analysis was performed using a dew point moisture analyzer to measure water activity (Aw). Water activity measurements were calibrated relative to an external standard of magnesium nitrate as a saturated solution with a water activity (Aw) of 0.592. Recorded water activity values were converted to moisture content (% moisture) against a cannabis isotherm-adsorption curve.

Analysis Specific Comments

Figure 6:
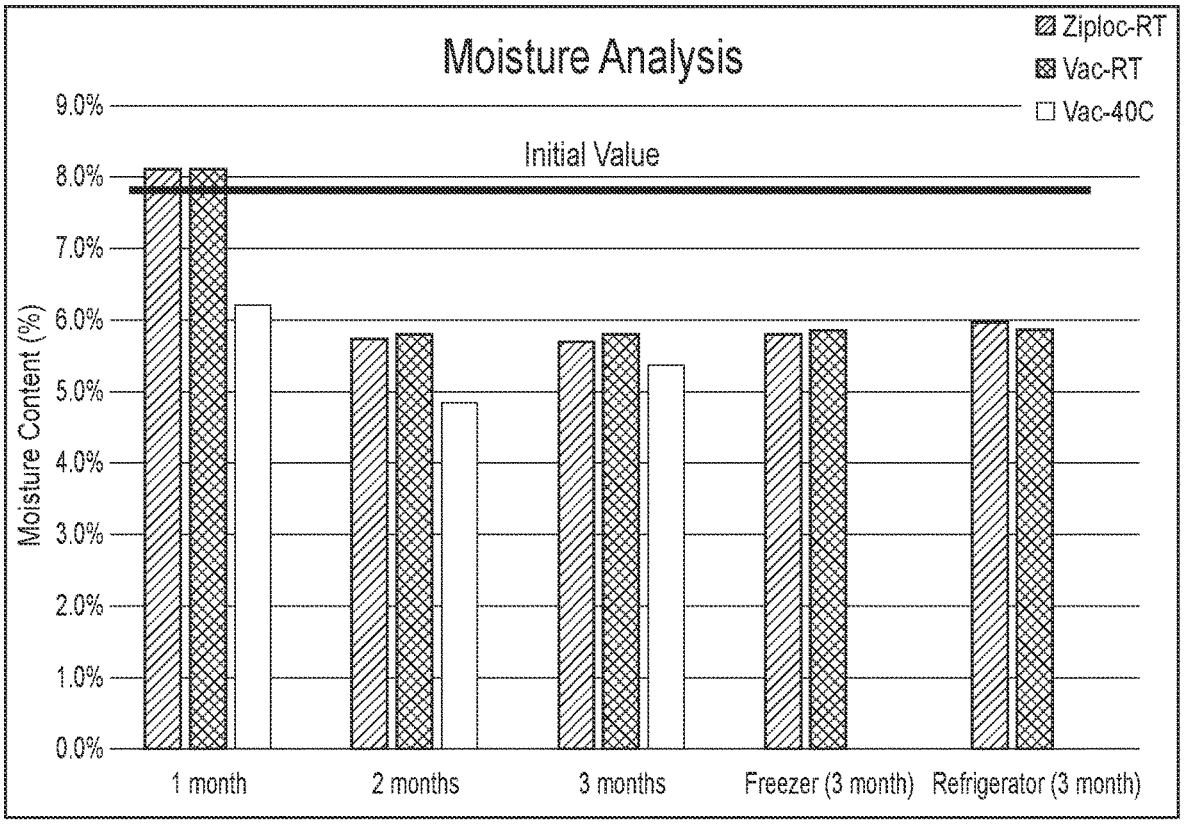
FIG. 6 shows measurement of moisture content for the samples, stored in various packaging under various conditions.

Moisture Content—As both cannabinoid and terpene concentrations are reported relative to the mass of the sample, which will be impacted by moisture content, understanding of overall moisture content for the individual samples is important in understanding all analytical data. Measurement of moisture content for the samples, stored in various packaging under various conditions are shown in Graph 1 (FIG. 6) below:

Graph 1 (FIG. 6)—Over the course of these experiments, all samples reached approximately the same level of moisture content, with the sample held at 40° C. reaching the equilibrium moisture content the fastest. As the packaging material has been designed to "breathe", this is not unexpected, permitting the sample at the higher temperature to dry more quickly than those held at ambient temperatures.

Figure 7:
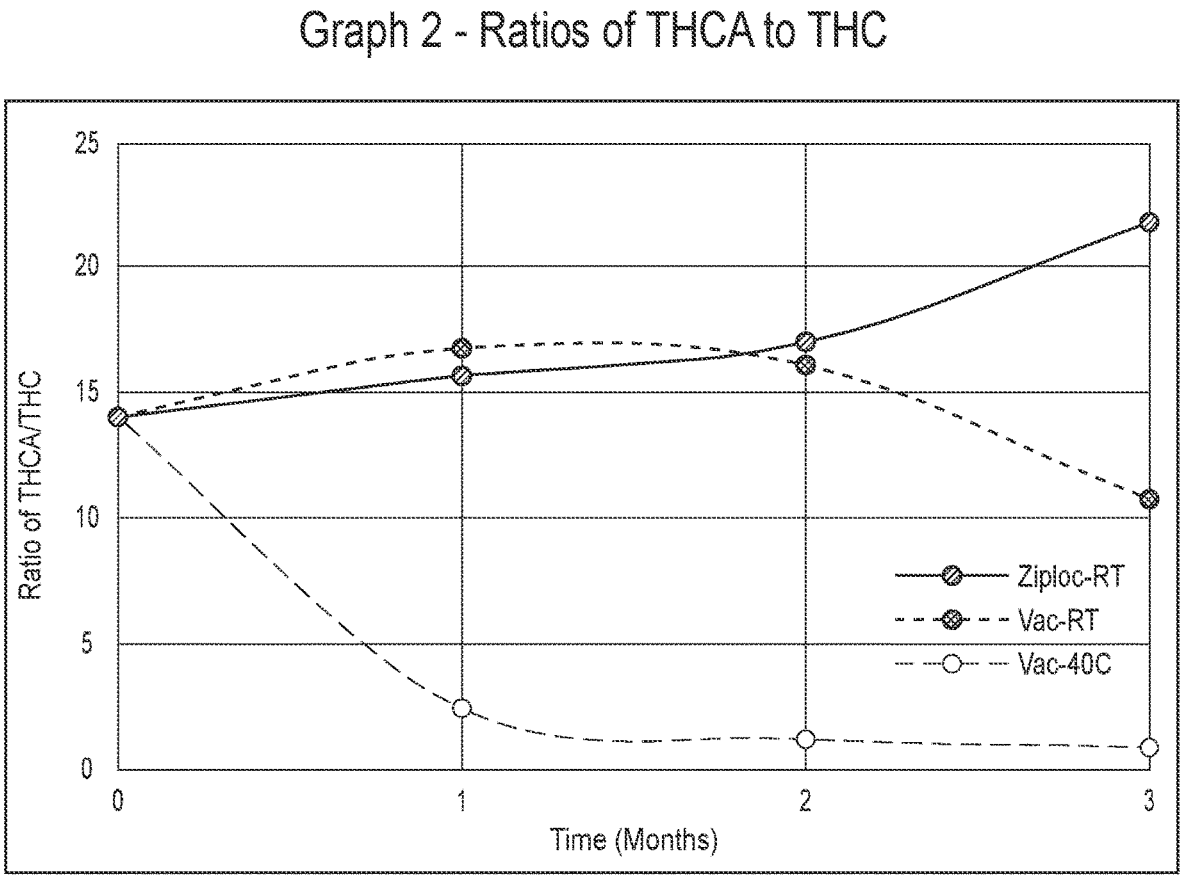
FIG. 7 shows a comparison of the ratio of THCA/THC for each sample.

Cannabinoid Content—As samples were held under both ambient (room temperature) and elevated temperature (40° C.), it was anticipated that at the elevated temperature, the THCA, the acidic form of the cannabinoid, would be converted or decarboxylated to THC, the neutral form of the cannabinoid. This is highlighted for these samples by comparing, for each sample, the ratio of THCA/THC, as shown in Graph 2 (FIG. 7).

Figure 8:
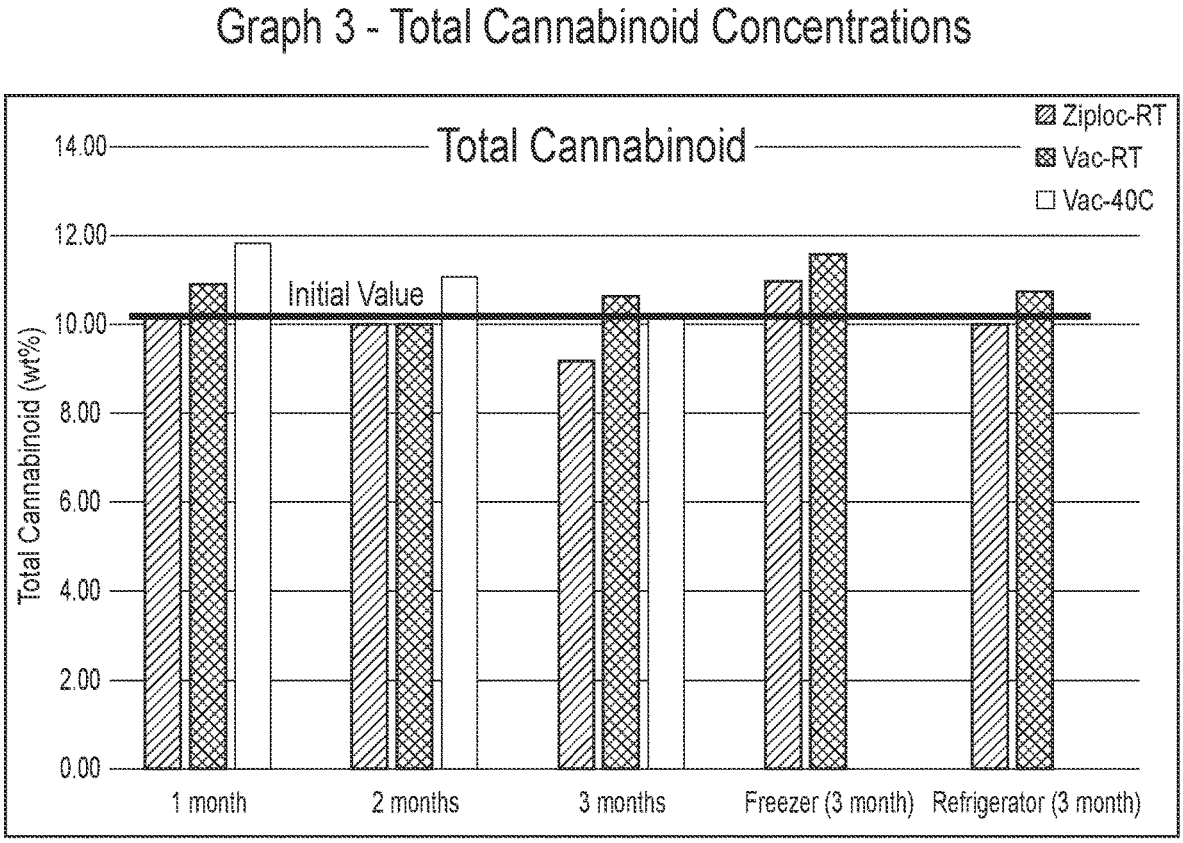
FIG. 8 shows a comparison of the total cannabinoid.

For the sample held at 40° C., significant decarboxylation was observed over the first month. The sample stored in vacuum packaging at ambient conditions was fairly stable for the first two months, with more evidence of decarboxylation visible after the second month. For the sample stored in Ziploc® bags under ambient conditions, an increase in the ratio of THCA/THC is observed. This can be accounted for by comparison of the total cannabinoid, shown in Graph 3 (FIG. 8), which shows for this sample a decrease in total THC. For this sample, the degradation of THC was more rapid than the degradation for THCA, resulting in the increase in the THCA/THC ratio. This is most likely a result of oxidative degradation of the cannabinoid in the Ziploc® bag, which was reduced for samples packaged under vacuum conditions.

During the decarboxylation process, there is a loss of a carboxylic acid group from the acidic form of the cannabinoid, such that the resulting neutral product weighs less than the original cannabinoid by a factor of 0.877. To account for this weight loss, the "Total Cannabinoid" concentrations are calculated by summation of all the acid concentrations, multiplied by this loss factor, then added to all the sum of all the neutral cannabinoids. This permits evaluation of products without the effects of conversion from one form of a cannabinoid to another. From the data shown in Graph 3 (FIG. 8), it can be seen that for several of the samples, there appears to be more total cannabinoid at the time of measurement, than what was present initially (represented by the horizontal line). This is, in part, a result of the loss of moisture, which would result in higher values than initially recorded. Even in consideration of the moisture loss, there is evidence of cannabinoid degradation for most packaging/storage conditions. It appears that there is a slightly more rapid degradation for samples in the Ziploc® bags, as mentioned previously, most likely due to oxidative degradation. Included in the graph are additional results for samples stored under freezer (−20° C.) or refrigerated (4° C.) conditions. Under each condition, the sample packaged under vacuum retained more total cannabinoid than sample packaged in Ziploc® bags. As anticipated, the colder storage temperatures provide greater retention of the cannabinoids, relative to warmer temperatures.

Figure 9:
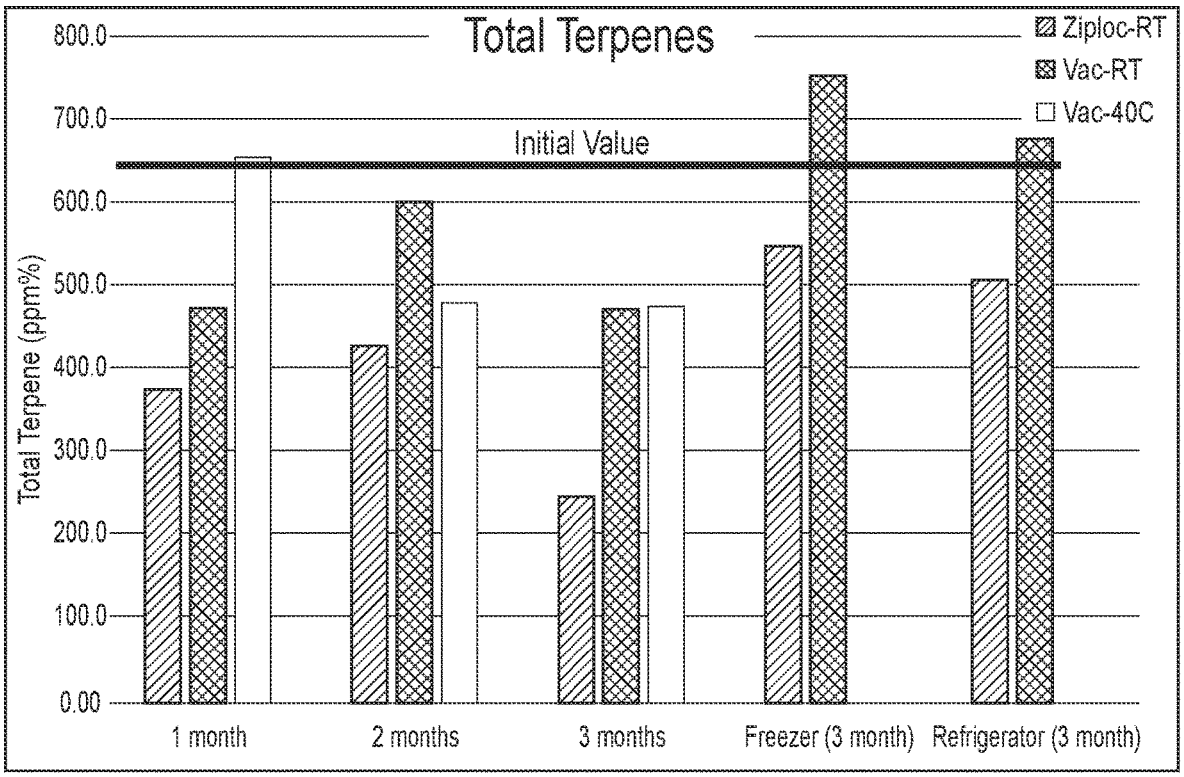
FIG. 9 shows total terpene concentrations.

Terpene Content (FIG. 9—Graph 4)—Monitoring the terpene concentrations proved more challenging. Many of the terpene structures are very closely related, such that degradation of one terpene may result in the formation of another terpene. So like the cannabinoids, evaluation of total terpenes may be more indicative of overall performance under each condition. Like the cannabinoids, the reported values will also be impacted by changes in moisture, which resulted in values greater than the initial conditions for some samples. Under each storage condition, samples stored in vacuum packaging retained more overall terpene concentrations relative to samples stored in the Ziploc® bags. This is not surprising, as terpene compounds are more prone to oxidative degradation than the cannabinoids. As was observed for the cannabinoids, samples stored at lower temperatures maintained higher concentrations of terpenes.

CONCLUSION

From these evaluations, it appears that the vacuum packaging had slightly better performance in maintaining cannabinoid and terpene concentrations, relative to a standard Ziploc® bag. But the differences did not, at lease during the first three months of this study, appear to be dramatic. There appears to be a general trend for all samples to degrade more with passing time, with a slightly higher rate of degradation for the less controlled Ziploc® bag samples. The elevated temperature of 40° C. is typically used to evaluate product stability in an accelerated manner, with a 4× acceleration factor for product aging, for samples which would normally be stored under ambient conditions (room temperature). With that in mind, the results here indicate that for samples packaged under vacuum conditions, in the specialize packaging, the total cannabinoid values had good stability for the 3-months of the study, indicative of product stability for 12 months under normal storage conditions. When considering terpene stability, the concentrations were only stable over the first month, indicative of product stability for 4 months, with regard to the terpenes under normal storage conditions. For each time point considered, under each storage condition, the vacuum packaging performed better than the sample packaged under ambient conditions, in the Ziploc® bags. This is most likely due to reduced oxidative degradation of the cannabinoids and terpenes for samples packaged under vacuum, relative to samples packaged with ambient air.

This description and the accompanying drawings herein are exemplary and provided for purposes of describing and understanding the invention, and are not intended to limit the scope or spirit of the invention.

I claim:

1. A method for packaging and storing fresh plant matter in a single-use consumer package unit having a bottom component and a top component, wherein the bottom component includes an upper planar flange surrounding a plurality of molded compartments, the molded compartments being configured for and forming a plurality of separable single-use consumer package units for receiving and containing the fresh plant matter, said method comprising the steps:

a) providing the bottom component comprising the plurality of molded compartments formed therein for receiving and containing a unit of fresh plant matter;

b) providing the unit of fresh plant matter processed to fit within the molded compartments formed in the bottom component;

c) placing the unit of fresh plant matter into said molded compartments of the bottom component; and d) vacuum sealing the package using a film component sealably affixed to the planar flange of the bottom component, whereby the film component forms the top component of the package unit.

2. The method of claim 1 further comprising the step of: washing and air-drying the fresh plant matter prior to placing the unit of fresh plant matter into said molded compartment.

3. The method of claim 1, wherein the method comprises the step of:

spraying or fogging the plant matter with a preservative prior to sealing.

4. The method of claim 1, wherein the plant matter is cannabis.

5. The method of claim 1, wherein the plant matter is fruit prepared in single-serving slices.

6. The method of claim 1 wherein the shelf-life of the fresh plant matter is extended compared with the shelf-life of fresh plant matter that is not packaged by the method of claim 1.

7. A single-use consumer package unit having a bottom component and a top component, the bottom component comprising a plurality of molded compartments formed therein and a peripheral edge surrounding the molded compartments, the molded compartments being configured for receiving and storing fresh plant matter processed to fit within the molded compartments and wherein the single-use consumer package unit is vacuum sealed by a semi-permeable film forming the top component of the single-use consumer packaging unit.

8. The single-use consumer package unit of claim 7, wherein the semi-permeable film is releasably affixed to the planar flange formed on the peripheral edge of the bottom component surrounding the molded compartment.

9. The single-use consumer package unit of claim 7, wherein the fresh plant matter is cannabis.

* * * * *